United States Patent [19]

Izumi

[11] Patent Number: 4,501,081

[45] Date of Patent: Feb. 26, 1985

[54] DRY FIRE UNIT

[76] Inventor: Michael T. Izumi, 601 N. Virgil Ave., Los Angeles, Calif. 90004

[21] Appl. No.: 428,431

[22] Filed: Sep. 29, 1982

[51] Int. Cl.[3] ..... F41C 27/00

[52] U.S. Cl. ..... 42/1 R; 42/90

[58] Field of Search ..... 42/1 R, 1 N, 65, 66, 42/67, 70 R, 70 F, 69 B, 58, 90; 89/27 R, 27 A; 102/444

[56] References Cited

U.S. PATENT DOCUMENTS

| | | | |
|---|---|---|---|
| 109,514 | 11/1870 | Hay . | |
| 282,941 | 8/1883 | Whitmore . | |
| 365,383 | 6/1887 | Holladay . | |
| 624,321 | 5/1899 | Fryberg . | |
| 2,327,334 | 8/1943 | Parker . | |
| 2,405,308 | 8/1946 | Jack | 102/444 |
| 3,128,570 | 4/1964 | Browning | 42/70 F |
| 3,217,441 | 11/1965 | Kerr | 102/444 |
| 3,444,639 | 5/1969 | Rockwood | 42/1 N |
| 3,678,609 | 7/1972 | Fazio | 42/1 N |
| 3,750,531 | 8/1973 | Angell et al. | 42/70 F |
| 3,760,522 | 9/1973 | Guhring . | |
| 3,762,089 | 10/1973 | Meyer, Jr. | 42/1 R |
| 3,838,533 | 10/1974 | Rugor . | |
| 3,848,350 | 11/1974 | Seminiano . | |

FOREIGN PATENT DOCUMENTS

| | | | |
|---|---|---|---|
| 692741 | 5/1940 | Fed. Rep. of Germany | 42/70 F |

*Primary Examiner*—Charles T. Jordan
*Assistant Examiner*—David K. Cornwell
*Attorney, Agent, or Firm*—Armstrong, Nikaido, Marmelstein & Kubovcik

[57] ABSTRACT

A dry fire unit which is placed in a gun in place of the firing pin is provided. The firing pin is removed and an energy-absorbing wedge of the dry fire unit is placed into the gun in lieu of the firing pin such that the dry fire unit is struck by the hammer of the gun when its trigger is pulled. The dry fire unit is an energy-absorbing wedge that allows the gun to be dry fired without cracking or peening the hammer. Further, since the dry fire unit replaces the firing pin, it is not necessary to remove ammunition from the gun since there is no possibility of the gun being fired.

8 Claims, 5 Drawing Figures

DRY FIRE UNIT

BACKGROUND OF THE INVENTION

1. Field of the Invention

This invention relates to dry firing apparatus for guns. More particularly, this invention relates to dry firing apparatus for guns having energy yielding hammers in which field it is desirable to provide a failsafe means for dry firing the guns with a cartridge in the firing chamber or breech.

2. Description of the Prior Art

Dry firing is an old practice used by shooters to develop trigger control, e.g., by detecting movement in the sight planes, i.e., up, down, left or right without having to contend with the gun's recoil and report. By repeatedly dry firing the gun, the shooter can develop control to minimize such errors.

One such dry fire system is described in U.S. Pat. No. 2,405,308, which discloses a dry firing cartridge-like device that is placed in the breech. However, since the cartridge like device is inactive, the gun is only failsafe if the gun is completely loaded with inactive ammunition. Thus, if the gun carries any live ammunition, it is not completely failsafe but is only failsafe until the live cartridge enters the cartridge firing chamber. It is also advantageous to reduce dust, reduce noise and/or make the hammer inoperative to render its energy to the cartridge and to eliminate damage to the firing pin and/or metal-to-metal battering, cracking or peening of the hammer and/or the firing pin stop in a variety of guns of the same caliber.

SUMMARY OF THE INVENTION

This invention overcomes the problems known heretofore by providing a dry fire unit that is placed into the gun in place of the firing pin. Moreover, this invention provides a dry fire unit that is placed into a gun in place of a removable firing pin for a trigger-actuated, energy-yielding hammer means forming metal parts of predetermined contacting surface areas that tend to be hammered when the hammer yields its energy. To this end, the dry fire unit comprises a means that is placed into the gun as a unit in lieu of the firing pin such that when the dry firing unit is struck by the hammer means an energy absorbing action is provided so as to allow the gun to be dry fired without cracking or peening the hammer means or the surface areas of the metal parts.

Moreover, in one embodiment, this invention has an energy absorbing means for a gun carrying live ammunition. To this end, the dry fire unit is combined with a gun having an energy yielding hammer means that is selectively positioned in a cocked and a released position and which has metal parts forming a cartridge chamber for a removable cartridge and a firing pin receiving means having a firing pin stop and sides to form a firing pin hole for selectively receiving at least a portion of the dry firing unit in lieu of the firing pin. In this embodiment, the dry fire unit comprises a shaft having an extension that is placed into the gun as a unit in lieu of the firing pin such that the unit and its extension are interposed between the energy yielding hammer means and the cartridge chamber for receiving and/or absorbing energy from the hammer without transmitting the energy to a cartridge in the cartridge chamber when the hammer is actuated from its cocked to its released position by the trigger. With the proper selection of elements, as described in more detail hereinafter, the desired dry fire unit is achieved.

OBJECTS OF THE INVENTION

It is accordingly an object of this invention to provide a dry fire unit made of a nonmetallic, energy absorbing material that is placed in a gun in place of the firing pin.

It is another object to provide a dry fire unit that may be placed in a gun having a live cartridge in the cartridge chamber without the danger of firing the cartridge.

It is another object to provide a dry firing unit that is placed in a gun to reduce the noise of the hammer action.

It is another object to prevent the metal-to-metal battering, cracking or peening of the hammer and/or the firing pin stop and the like during dry firing.

It is still another object to make the hammer inoperative to render its energy to a cartridge in the cartridge chamber or breech of a variety of guns, including firearms of like calibers when the dry firing unit is placed in a gun.

The above and other novel features and advantages of this invention will appear more fully from the following detailed description when read in connection with the accompanying drawings and the novel features will be particularly pointed out in the appended claims. However, it is understood that the drawings are for the purpose of illustration only.

BRIEF DESCRIPTION OF THE DRAWINGS

In the drawings wherein like elements are referenced alike.

DETAILED DESCRIPTION OF THE PREFERRED EMBODIMENT

Figure 1:
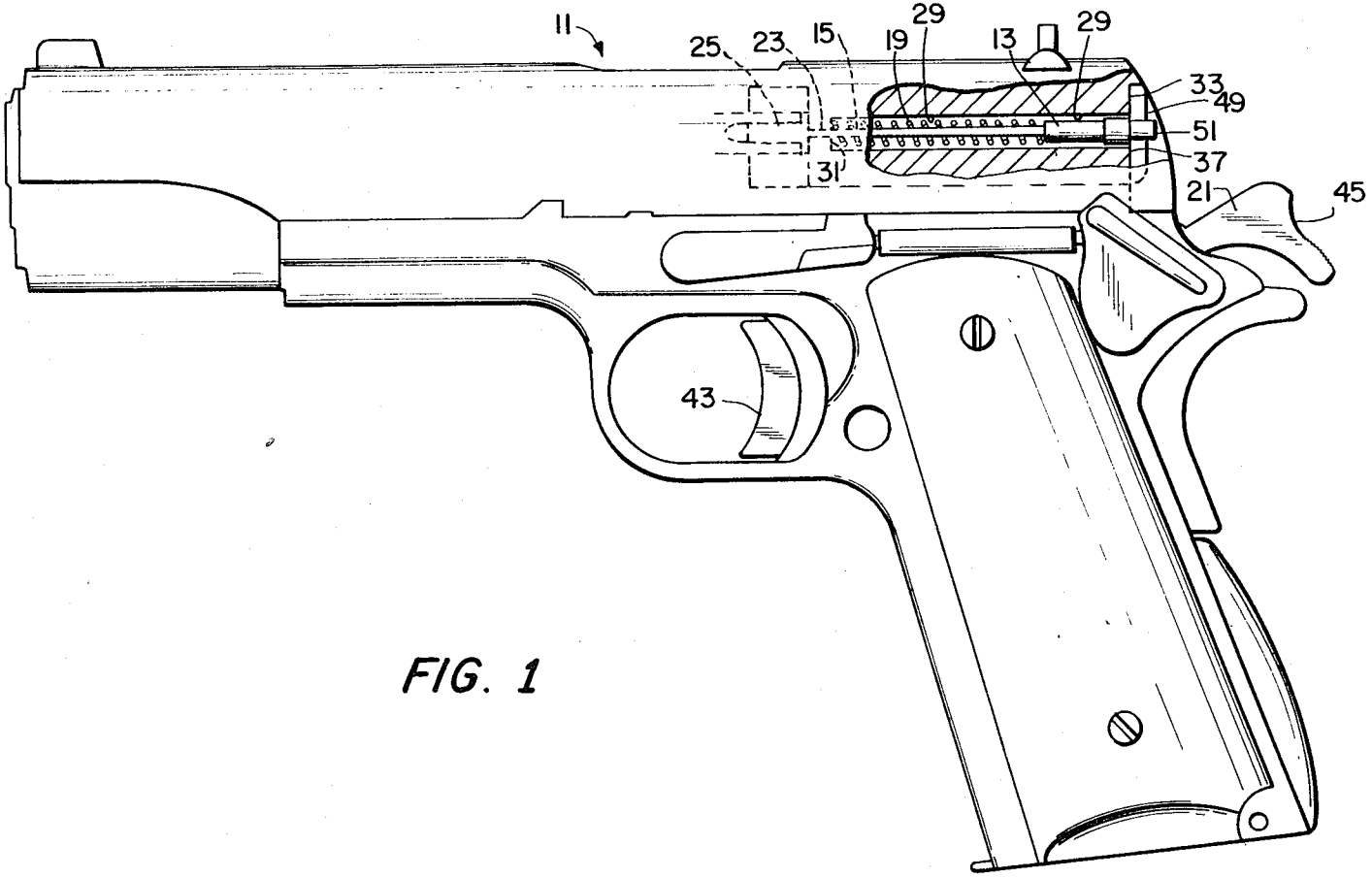
FIG. 1 is a side view of a standard gun having a firing pin assembly.
Figure 2:
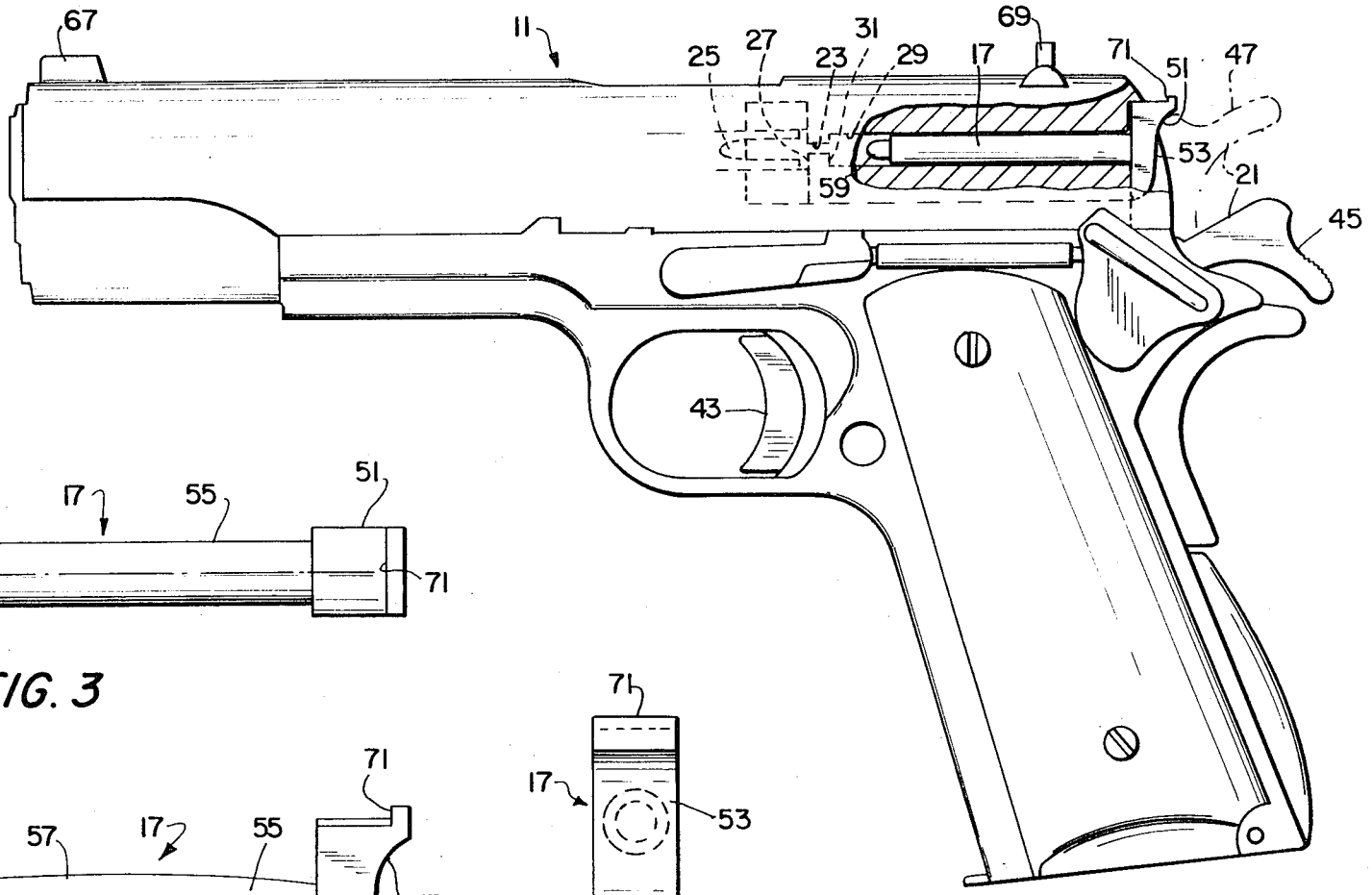
FIG. 2 is a side view of the gun of FIG. 1 showing the dry firing unit of this invention that replaced the firing pin of FIG. 1.
Figure 5:
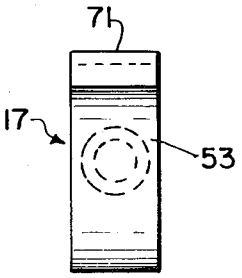
FIG. 5 is a end view of the dry firing unit of FIG. 4.
Figure 3:
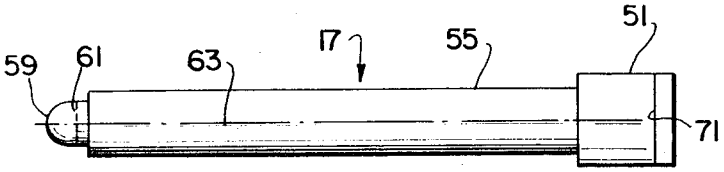
FIG. 3 is a top view of the dry firing unit embodying the present invention.

Referring to FIG. 1, there is shown a partial side view of a standard gun 11, such as an M1911 Colt .45 ACP handgun, with which the dry firing unit of this invention is particularly useful. However, it should be noted that the dry firing unit of this invention has applications to other makes of firearms of the same and different calibers. As an example, the Browning 9MM Hi-Power handgun has the same type of firing pin mechanism and firing pin as the firing pin mechanism 13 and firing pin 15, and could use a similar type dry firing unit of different dimensions. On the other hand, the dry firing unit 17 of this invention, which is shown in FIG. 2, although specifically made for the M1911 Colt .45 ACP handgun 11 illustrated in FIGS. 1 and 2, can be interchanged with a Detronics or AMT handgun or other firearms of a wide variety of types and applications. It can also interchange between different calibers as understood in more detail hereinafter.

Referring to FIGS. 1 and 2, the gun 11 has a firing pin mechanism 13 which includes a firing pin 15 and a firing pin biasing spring 19 that when compressed biases the firing pin backwardly into its firing position. There-upon, hammer 21 causes release of the spring 19 and forces the firing pin 15 in firing pin hole 23 to move the firing pin 15 against the back end of a cartridge 25 in cartridge chamber 27, thus to actuate or fire the cartridge in a conventional manner well known in the art such that the details of the cartridge, which are not part of this invention, need not be shown. Likewise, the energy-yielding hammer is actuated in a conventional manner by a trigger mechanism, which is not part of this invention and thus is simply shown for ease of explanation. One such cartridge-like device and one such conventional trigger-actuated, energy yielding hammer and trigger actuating mechanism is shown in the above-referenced U.S. Pat. No. 2,405,308, which is incorporated by reference herein.

As shown in FIG. 1 only, the gun 11 has a removable firing pin 15 and a spring 19 with the firing pin in its ready-for-firing position after the trigger actuated energy-yielding hammer 21 yields its energy causing the spring 19 to bias the firing pin 15 in firing pinhole 23 toward a cartridge 25 in cartridge chamber 27.

In biasing the firing pin back and forth in firing pin receiving means 29 which forms the firing pinhole 23, the pin's biasing movement is limited in the firing position by a first firing pin stop 31 at one end of hole 23. Likewise, the pin biasing movement is limited in the opposite or ready for firing position by a removable second stop 33 at the opposite end of hole 23. In both cases, the stopping is caused by the metal-to-metal contact of the firing pin 15 comprising the respective metal-to-metal contact of the stopping surfaces 31 and 33.

All of these surfaces have predetermined surface areas that are subject to hammering, peening and the like due to the actuation of the energy-yielding hammer 21 against the firing pin 15 by the trigger 43. The hammer 21 is also subject to hammering, peening and even cracking when it is actuated from its cocked position 45 to its released position 47 due to the metal-to-metal impact with either the firing pin 15 when in the gun 11 or the back of the stop 49 on the firing pin receiving and forming means 29 when the dry fire unit 17 of this invention replaces the firing pin 15 as shown in FIG. 2. Thus should the firing pin 15 be replaced by the dry firing unit 17 of this invention, the peening, hammering, cracking of metal-to-metal parts and other problems are avoided.

As shown in FIGS. 2–5, the dry firing unit 17 of this invention comprises a projecting end 51 forming a hammer receiving surface indicated by numeral 53 and a longitudinally extending shaft 55 preferably in the form of an arch as indicated by the numeral 57. As shown in the top view of FIG. 3, the shaft 55 has a generally uniform cross-section and a substantially straight configuration that ends in a rounded portion 59 of reduced diameter 61 which is substantially centered on the longitudinally extending axis 63.

Figure 4:
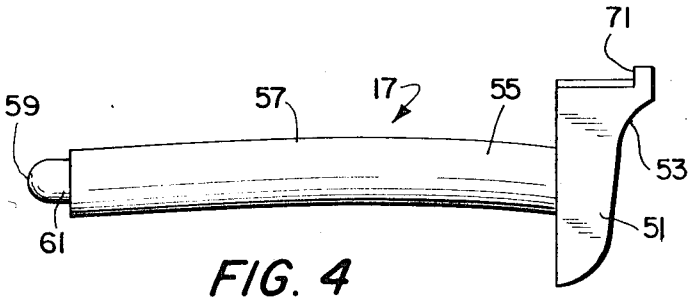
FIG. 4 is a elevation of the dry firing unit embodying the present invention.

As shown in the elevation of FIG. 4, the shaft 55 is arched. This arch is shaped to come into frictional contact with the sides of the firing pin receiving means 29. In this connection, the firing pin spring 19 is removed. Thus, without the arch, there would be a clearance between the outside diameter of the shaft 57 and the inside diameter of the firing pin receiving means 29 which is shown in FIG. 2.

As shown in FIG. 4, the expended or projecting end 51 of the dry firing unit 17 has a hammer receiving surface 53 for receiving the energy yielded by the hammer 21 when the hammer is actuated by the trigger to move from cocked position to released position 47, as shown in FIG. 2. In the latter position, the projecting end 51 of the unit 17 is wedged between the hammer 21 and the surface of the body of the gun 11, where parts form the firing pin receiving means 29 for selectively holding the removable firing pin 15.

Advantageously the dry fire unit 17 is made of a material characterized as follows: energy absorbing able to withstand compressive impact loading without failing or permanently deforming; relatively low coefficient of friction; impervious to oil, grease and oil/grease solvents; opaque and colorable, such as with a bright orange dye; having injection molding or cast molding capabilities for ease and efficiency of production; being able to withstand light shear loads at the end of the firing pinhole and the like; being able to withstand flexture loading along its longitudinal and vertical axes 66 and 66'; having at least some elastic memory for absorbing energy from the hammer by elastically yielding to the thrust of the hammer and returning to the original undeformed state of the dry firing unit for the beginning of another cycle.

Suitable materials for the dry firing unit 17 comprise nylon 6/6 or 6, glass fiber reinforced; polyphenol sulfone; polyethylene; polyester thermoplastic; polyester thermosets and urethane rubber, which are all synthetic non-metallic materials.

Advantageously the hammer receiving surface 53 of the dry firing unit 17 has a larger surface area of contact than the original firing pin stop/hammer contact surface. This larger area decreases the contact pressure of the falling hammer, thus increasing the cushioning capacity produced by hammer when it falls on the firing pin. Still further, the larger area of the rear end of the unit 17 seals the end of the firing pinhole against the entry of dust, dirt and the like therein. To this end also, the end 51 of unit 17 is large enough to protrude between the contacting surfaces of the hammer and the gun body, both when the hammer is in the cocked and released positions. Thus, the end 51 is clearly visible at all times, especially if it is advantageously colored a bright orange by an orange dye during its manufacture, e.g., from glass-fiber reinforced nylon which can be suitably molded by conventional apparatus. However, the end 51 is not so enlarged as to protrude into or beyond the line of sight between the front sight 67 and the rear sight 69. To this end, the projecting end 51 of unit 17 protrudes sufficiently to surround and encompass the hammer in its released position 47 to absorb energy yielded by the hammer movement, which is arcuate, but low enough to be below the line of sight along sights 67 and 69. Lip 71 is provided for gripping to remove the dry fire unit 17 from the firing pin receiving means 29.

In the operation of the gun 11 and its dry firing mode, the operator sights along sights 67 and 69 and pulls the trigger 43 to actuate the hammer allowing it to strike projecting end 51 of the unit 17, acting as a wedge between the between the hammer 21 and the gun body. When dry firing, the shooter can detect movement of the sight plane, i.e., up, down, left or right without having to contend with the gun's recoil and report. By repeatedly dry firing, the shooter can develop control to minimize such errors without damaging the metal-to-metal contacting surfaces of the firing pin 15 the hammer 21 and the gun 11, which are both accurately machined to predetermined surface area sizes. Moreover, by removing the firing pin assembly, no damage can occur by the impact of the hammer striking unyielding metal parts. Likewise, cumulative deleterious results, which can require costly repairs, are avoided in accordance with this invention.

When the dry firing unit 17 is in the firing pinhole 23, its arched shaft 57 frictionally contacts the sides of firing pinhole 23 so that it maintains its position for repeated dry firing in a failsafe manner with or without live cartridges 25 in the cartridge chamber 27. And while the dry firing unit is compressed to elastically expand the longitudinally extending shaft 55 in the firing pinhole, it absorbs the energy yielded by the hammer during its dry firing mode of operation and, the entire dry firing unit returns with elastic memory to its original ready-for-firing configuration, which is still sufficiently sized to prevent dust, dirt and the like from entering the firing pinhole. However, in no case does the shaft 55 of the dry firing unit 17 yield any hammer energy to the cartridge 25 or the cartridge chamber since the shaft 55 is always too short to reach that far.

At the beginning and during the cycle for dry firing the gun 11, the dry firing unit 17 of this invention is always clearly visible. Thus, the operator is always reminded that the dry firing unit is in place and the gun 11 is completely failsafe, even with live ammunition present in the gun. Moreover, the operator is always reminded that the unit 17 is substituted for the firing pin assembly, and, which must be removed and must replace the dry firing unit 17 in order to make the gun operable for live ammunition at the beginning of a new cycle for live firing the gun when it is desired that such a cycle be begun. In the latter case, in contrast to the dry firing cycle of this invention, there is almost always a possibility of unwanted or accidental discharge of the gun 11. This is true even when the gun has a safety or guard since the removal of either is easily accomplished and has the result that it permits the hammer to actuate the firing pin which is then in place. Likewise, this invention is inexpensive to make and simple to install and operate without complicated firing pin and/or hammer adjustments since all conventional guns have easily removable firing pins which, upon removal, can be replaced by the dry firing unit 17 of this invention. Moreover, this dry firing unit can be used in a large number and variety of guns of the same caliber and can be used with a large variety of guns having trigger-actuated, energy-yielding hammers and removable firing pins.

This invention has the advantage of providing a quiet dust and dirt resistant, colored and clearly visible dry firing unit that absorbs energy to avoid hammering, peening, cracking and accumulated wear in conventional gun hammers and firing pins and to reduce the noise of dry firing the gun. Moreover, the dry firing unit is completely failsafe even with live ammunition in the cartridge chamber or breech since the dry firing unit of this invention is used in lieu of the conventional firing pin.

I claim:

1. In combination with a gun having a frame, a hammer movable from a cocked position to an energy releasing position, a firing pin receiving means in the frame, a cartridge chamber, a removable firing pin assembly including a firing pin and a spring to actuate the firing pin, and said firing pin receiving means terminating in a firing pin hole through which the firing pin may travel to contact and fire a cartridge in the cartridge chamber, a dry firing unit which comprises a shaft of energy absorbing material adapted to be removably disposed in the firing pin receiving means, and a projection at one end of said shaft protruding longitudinally and laterally from said firing pin receiving means in the path of travel of said hammer to contact and absorb energy from said hammer, said unit being shorter in its longitudinal extent into the firing pin receiving means than the firing pin assembly.

2. A dry firing unit as claimed in claim 1 wherein said shaft has a rounded protruberance at its other end to prevent entry of said shaft into said firing pin hole.

3. A dry firing unit as claimed in claim 1 wherein said shaft is frictionally engaged in said firing pin receiving means to assist in absorbing energy from said hammer.

4. A dry firing unit as claimed in claim 1 wherein said shaft has a longitudinal arch to increase its frictional engagement in said firing pin receiving means.

5. A dry firing unit as claimed in claim 1 wherein said unit is made of a resilient, energy absorbing material which may be molded in a single piece.

6. A dry firing unit as claimed in claim 1 wherein said unit is readily visible at the opening of saif firing pin receiving means.

7. A dry firing unit as claimed in claim 1 wherein said unit is colored.

8. A dry firing unit as claimed in claim 1 wherein the projection at one end has a lip for engagement to grip and remove the unit.

* * * * *